United States Patent [19]

Smith

[11] Patent Number: 4,686,804

[45] Date of Patent: Aug. 18, 1987

[54] PREFABRICATED PANELIZED NUCLEAR-HARDENED SHELTER

[76] Inventor: Randley A. Smith, 1608 Bessemer, El Paso, Tex. 79936

[21] Appl. No.: 539,236

[22] Filed: Oct. 5, 1983

[51] Int. Cl.[4] ..... E02D 27/00

[52] U.S. Cl. ..... 52/169.6; 52/80; 52/293; 52/584; 109/1 S; 109/68; 109/79; 403/330

[58] Field of Search ..... 52/80, 98, 99, 100, 52/169.5, 169.6, 293, 436–439, 561, 562, 568–572, 578, 584–604, 604–612, 127.1, 127.2, 127.7, 127.8, 127.11; 350/265, 96.10; 109/1 S, 67, 68, 78, 79; 403/330, 335, 338

[56] References Cited

U.S. PATENT DOCUMENTS

| | | | |
|---|---|---|---|
| 1,889,355 | 11/1932 | Greenhill | 52/582 |
| 1,954,048 | 4/1934 | Jeffrey | 403/330 |
| 2,346,196 | 4/1944 | Starret | 109/1 S |
| 2,717,093 | 9/1955 | Mautner | 52/584 |
| 2,727,996 | 12/1955 | Rockwell, III et al. | 109/1 S |
| 2,853,751 | 9/1958 | Schlueter | 52/127.7 |
| 3,049,835 | 8/1962 | Sundstrum | 52/169.6 |
| 3,075,448 | 1/1963 | Cohen | 109/1 S |
| 3,093,098 | 6/1963 | Rosenfeld | 109/64 |
| 3,164,111 | 1/1965 | Lanni | 52/169.6 |
| 3,173,387 | 3/1965 | Cree, Jr. | 109/58 |
| 3,196,813 | 7/1965 | McHugh, Jr. | 52/169.6 |
| 3,212,220 | 10/1965 | Boniecki et al. | 52/169.6 |
| 3,284,969 | 11/1966 | Walters et al. | 52/578 |
| 3,296,755 | 1/1967 | Chisholm | 52/169.6 |
| 3,517,467 | 6/1970 | Propst et al. | 52/584 |
| 3,610,092 | 10/1971 | Miller | 403/330 |
| 3,661,410 | 5/1972 | Larson et al. | 52/582 |
| 3,974,599 | 8/1976 | Grosh | 52/169.6 |
| 4,023,317 | 5/1977 | Bettger | 52/80 |
| 4,045,935 | 9/1977 | Morris | 52/599 |
| 4,297,000 | 10/1981 | Fries | 350/265 |
| 4,302,069 | 11/1981 | Niemi | 350/96.1 |
| 4,353,194 | 10/1982 | Norton | 52/169.6 |

FOREIGN PATENT DOCUMENTS

| | | | |
|---|---|---|---|
| 1081647 | 5/1960 | Fed. Rep. of Germany . | |
| 15339 | 2/1977 | Japan | 350/96.1 |
| 520326 | 4/1940 | United Kingdom . | |
| 547564 | 5/1977 | U.S.S.R. | 403/330 |
| 781263 | 11/1980 | U.S.S.R. | 52/167 |

OTHER PUBLICATIONS

Popular Mechanics, Plastic Igloo, Mar. 1951, pp. 157, 162.

Kirk–Othmer Encyclopedia of Chemical Technology, Third Edition, vol. 4, p. 98, published by John Wiley & Sons.

*Primary Examiner*—John E. Murtagh
*Assistant Examiner*—Andrew Joseph Rudy
*Attorney, Agent, or Firm*—Beveridge, DeGrandi & Weilacher

[57] ABSTRACT

A shelter 20 to enable occupants thereof to survive a near-strike nuclear detonation as well as chemical, biological and conventional weapons attacks can be assembled by four men in thirty minutes. Panels 38 are lightweight laminates of plastics and reinforcing fibers. As installed underground, the arched roof 26 of the shelter 20 is supported on a drive ring base member 28, which is crushable to absorb, attenuate and help divert the airslap force of a nuclear detonation.

39 Claims, 15 Drawing Figures

FIG. 2
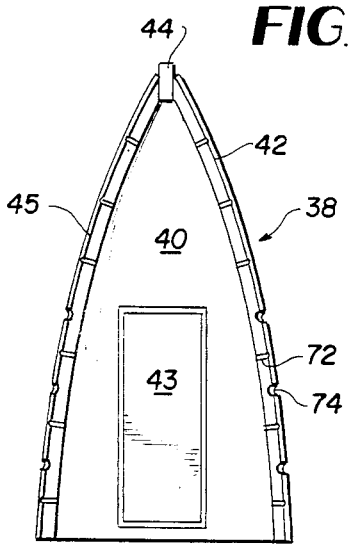
FIG. 3
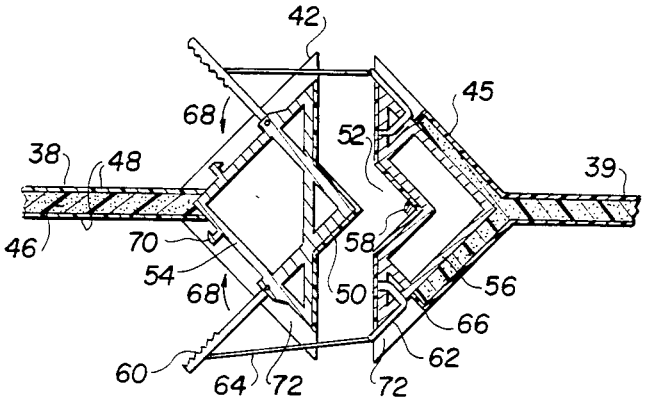
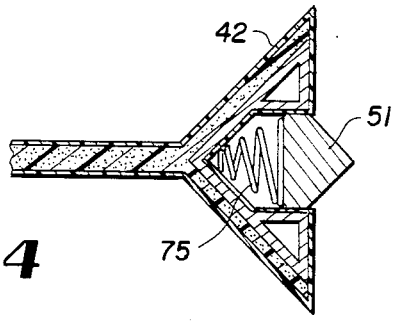
FIG. 4
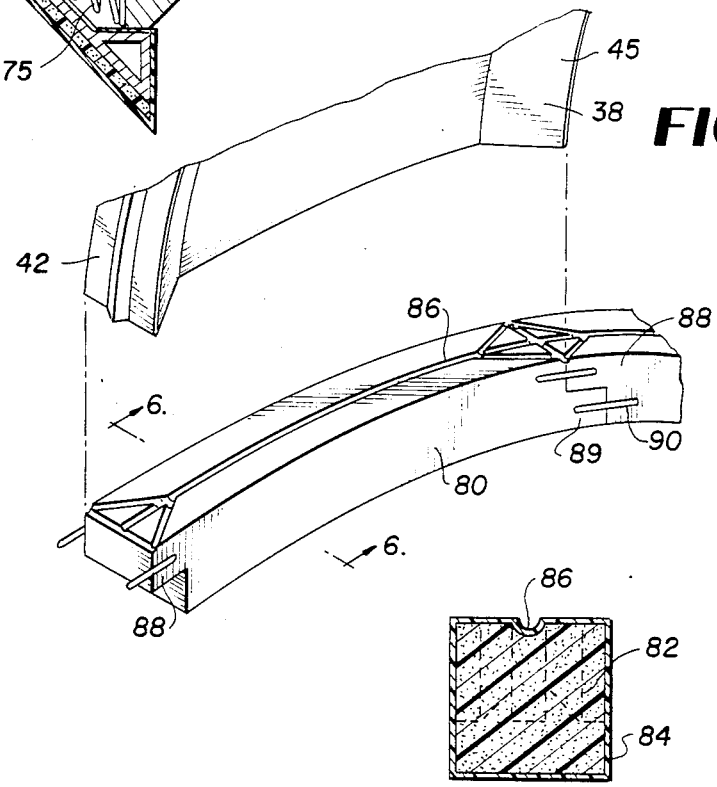
FIG. 5
FIG. 6

FIG. 7
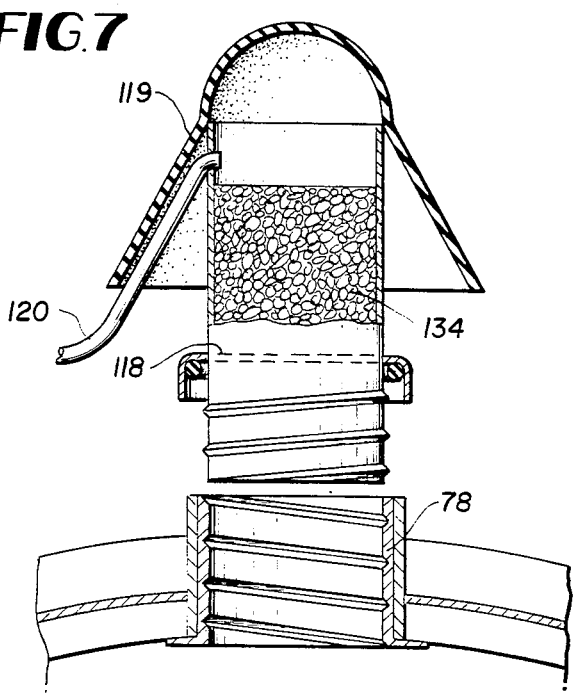
FIG. 9
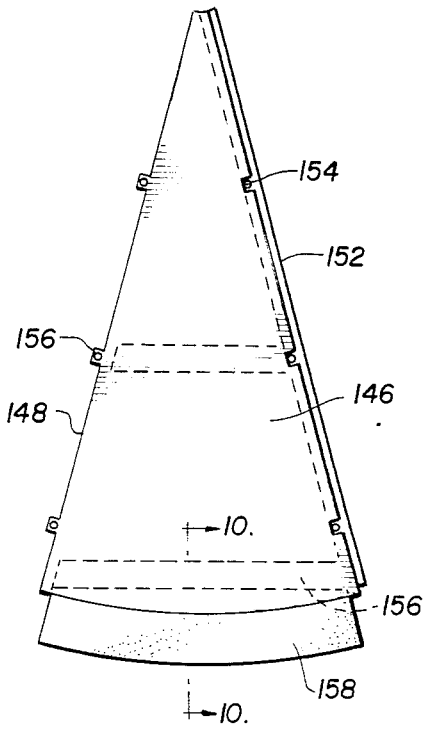
FIG. 8
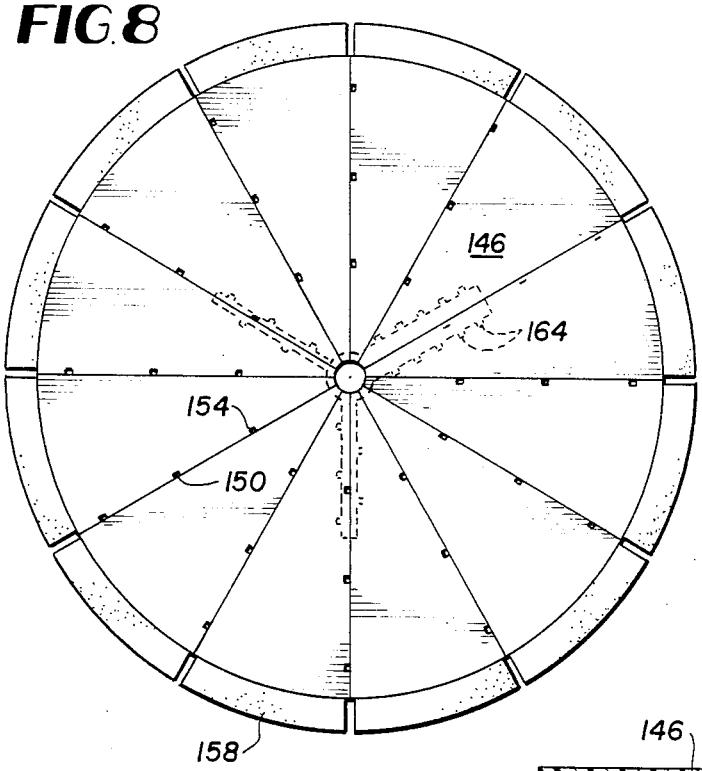
FIG. 11
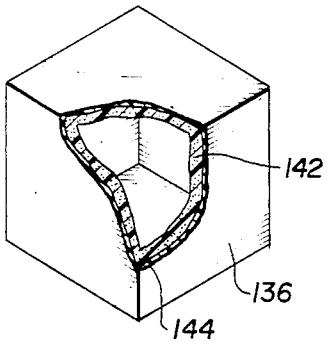
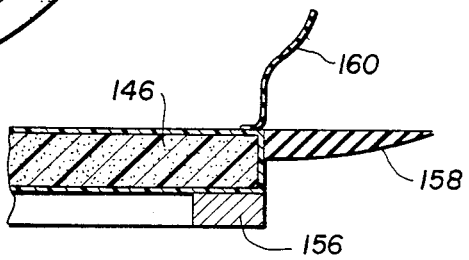
FIG. 10

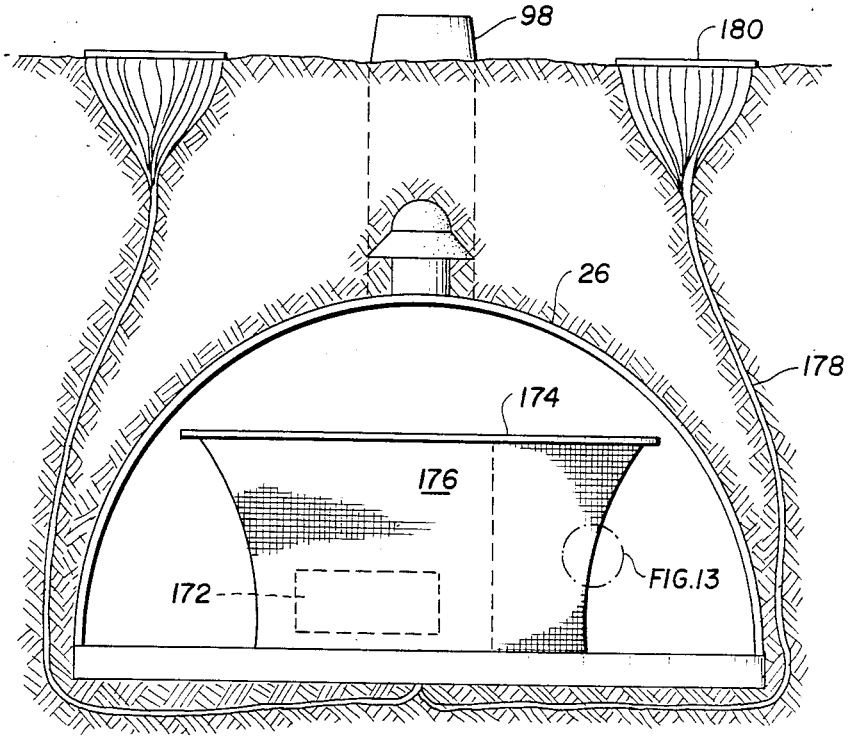
FIG.12
FIG.13
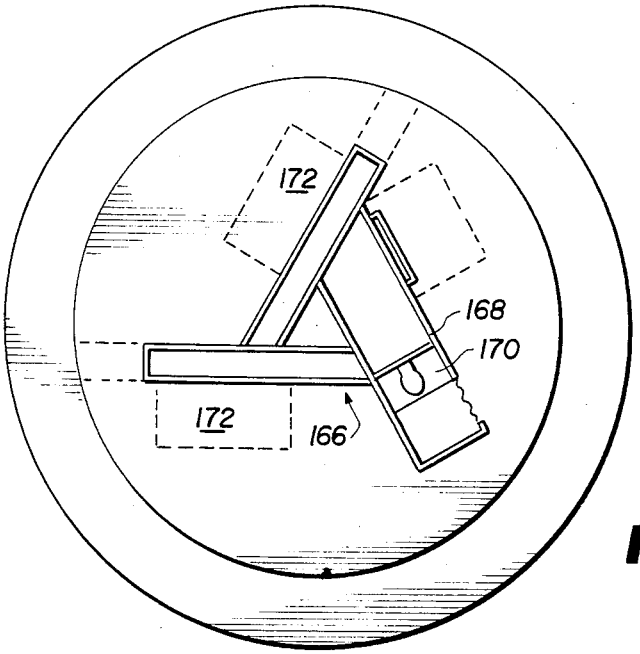
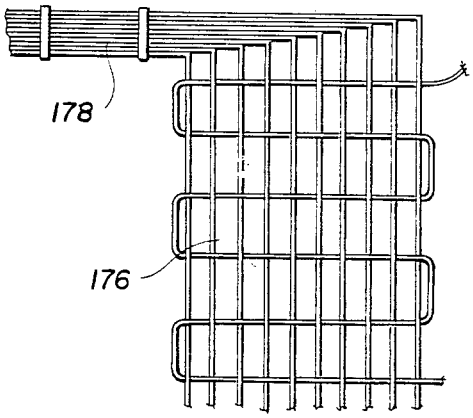
FIG.14
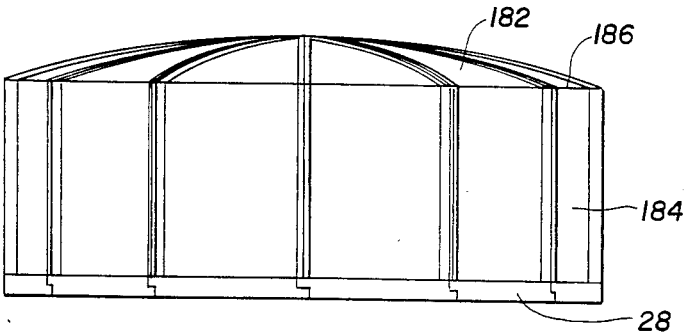
FIG.15

PREFABRICATED PANELIZED NUCLEAR-HARDENED SHELTER

The present invention relates to shelters for protection of persons and things from weapons, and more particularly from protection from both the prompt and residual effects of a near strike detonation of a nuclear weapon.

The horrors of war have been known since time immemorial and man has attempted various means and methods for protecting persons and things from the destructive effects of weapons. With the advent of nuclear weapons those horrors have greatly increased, but progress in providing protection has not kept pace. It is an object of the present invention to provide a shelter which will be effective protection for occupants therein from the prompt and residual effects of a near strike of a nuclear weapon, in addition to the destructive effects of conventional, chemical and biological warfare agents.

Past attempts at providing protection against conventional weapons include the structure disclosed in British patent specification No. 520,326 to Smith in which a prefabricated shelter is made of steel reinforced concrete panels which can be combined to form a tunnel-like chamber. However, the panels are of such weight and bulk that they require considerable time and effort to assemble.

U.S. Pat. No. 2,346,196 to Starret discloses a dome-shaped bomb proof shelter made of massive amounts of reinforced concrete, requiring extensive effort over a considerable period of time to construct. U.S. Pat. No. 3,196,813 to McHugh, Jr. discloses another underground bomb shelter, but one that is unlikely to survive a near strike nuclear detonation.

In contrast to these prior efforts, applicant's shelter is assembled of prefabricated panels which are lightweight so that each may be handled by two men. The entire shelter can be assembled in a time period measured in minutes, as opposed to days, weeks or months needed for prior shelters.

Other attempts at forming underground shelters of prefabricated materials are disclosed in U.S. Pat. Nos. 3,173,387 to Cree, Jr., 3,212,220 to Boniecki et al., and 3,296,755 to Chisholm. These however provide, at most, protection from fallout, and not from the near strike effects of nuclear weapons.

Those effects are multiple. The prompt effects are initial radiation, a thermal pulse, an electromagnetic pulse, and blast waves.

The effects of the detonation of a 20 megaton weapon at an air burst altitude of 2.5 miles experienced at 1.1 miles from ground zero include a prompt radiation intensity of 30,000 rem and a thermal pulse of 5,000 calories per square centimeter. Such a detonation's blast wave includes a barometric overpressure of 75 lbs/square inch and a dynamic pressure traveling wave of 200 lbs/square inch generating a 2,000 mph wind. Further descriptions of the effects of such weapons are given in *The Effect of Nuclear Weapons* by Samuel Gladstone and Philip J. Dolan, published in 1977 by the U.S. Department of Defense and the Energy Research and Development Administration.

The prompt radiation includes neutrons having an energy as high as twelve to sixteen MeV and gamma rays, which can only be stopped by mass shielding. Suitable shielding consists of eight feet of earth. Thus, protection against this form of radiation is effected by burial underground, which also protects against the thermal pulse of the detonation and shields against the radiation emitted by fallout. Locating the shelter underground also avoids the effect of the high wind characteristics of the blast's dynamic pressure.

The blast wave barometric overpressure is a traveling wave front and is transmitted from the air into the ground through a process known as air slap. The slap continues vertically downward into the ground for a considerable distance as a downward force. The above-described shelters of the prior art were not designed to survive such an air slap, but the present invention is.

The shelter of the present invention is designed to survive attacks by conventional, biological, and chemical weapons as well. The shelter provides protection against the agents of chemical and biological weapons by providing an air-tight and water-tight construction and filtering ventilation air. Additionally, it provides protection against the concussive and thermal effects of conventional weapons by its underground emplacement. It provides protection against an oxygen debt in the atmosphere caused by incendiary weapons by virtue of the sealing capability or its ventilation system.

The invention is suited for assembly on site by a non-skilled work force of only four men in a matter of minutes, with no manufacturing equipment. It is made in a panelized design, with the panels packaged as a complete unit for shipment from the factory to storage, and on to the site where it is to be assembled. This makes it practical to quickly build a nuclear hardened shelter at the time and place needed, even at a forward combat position. Indeed a particularly suitable use of this invention is as a shelter for tactical military forces. Such forces have not had available to them a kit of materials which can be readily and reliably assembled into a nuclear hardened shelter on short notice.

Thus, there is a need in the art for a nuclear hardened shelter which can be quickly assembled and will protect the occupants therein from the adverse effects of a near strike of a nuclear weapon, as well as conventional, biological and chemical weapons.

SUMMARY OF THE INVENTION

The present invention fulfills this need by providing a shelter to protect occcupants therein from blast waves created by nuclear detonations and includes a crushable base member and an arched roof, lower edges of which are supported by the base member.

When the shelter is buried below ground and a nuclear device is detonated above ground proximate the shelter, dynamic pressure generated by the detonation is attenuated by the defiladed location of the shelter, and barometric overpressure generated by the detonation is diverted by deflection of the roof vertically downward toward the base member thereby crushing the base member, and by transmission of overpressure through ground surrounding the arched roof. The underground location also provides protection against prompt radiation, thermal pulse, fallout radiation, and biological, chemical and conventional weapons. The shelter can take several embodiments and forms following within the scope of the invention.

The preferred roof shape is a dome.

The roof is made up of a plurality of curved wedge section panels and has a zenith, and the section panels abut a compression ring at the zenith.

The wedge section panels are laminates of rigid sheathing and a foamed plastic core and have metal edge reinforcements. The sheathing is a fiber-reinforced thermosetting plastic. Adjacent panels meet at caulked tongue and groove joints and are held together by manually operable retaining means affixed to the panels. The retaining means include a handle mounted on a surface of one panel and pivotable between an open position in which it is angled to the panel surface and a closed position in which it is juxtaposed the panel surface. A latch extends from the handle and a receptor for the latch is located on the adjacent panel. The latch may be inserted in the receptor when the handle is in its open position and may be tensioned to draw the panels together by moving the handle to its closed position. The retaining means may also include a means for holding the handle in its close position.

A floor is located under the roof but not connected to the roof or the base member. The floor is made up of a plurality of planar wedge section panels which have truss reinforcements. The planar panels include peripheral skirting engaging the domed roof in watertight manner. Interior walls are supported on the floor, and an upper deck is supported on the interior walls. The interior walls are provided with sanitation fixtures.

The crushable base member is a ring made up of a plurality of arcuate sections. The arcuate sections are laminates of a rigid sheathing and a foamed plastic core and are fracturable to allow the roof to crush them in response to the barometric overpressure of a nuclear detonation.

The shelter includes an entryway having a lateral passageway extending substantially horizontally from the roof to a distal end and a downtube extending from the distal end of the lateral passageway upward to a truncated conical top above ground when the roof is below ground. The truncated conical top is coated with an ablative material. The lateral passageway and downtube are made of laminated panels including a rigid sheathing and a foamed plastic core. The sheathing is a fiber-reinforced thermosetting plastic, and at least some of the fibers conduct light and have transverse light outlets to release light therefrom to the lateral passageway.

The entryway has a series of doors made of materials which attenuate radiation. One of the doors is made of iron for attenuating the energy of fast neutrons by inlastic scattering. Another door includes layers of polyethylene film for attenuating the energy of neutrons by elastic scattering. Another includes a layer of boron carbide particles dispersed in a matrix of aluminum and a layer of lead. Preferably, there is a plurality of such two layer doors, alternate ones of which are hinged to opposite sides of the entryway.

The shelter has a ventilation system including an outlet from the top of the roof connected by a first conduit to an exhaust port in the downtube of the entryway. An inlet to a lower level of the roof is connected by a second conduit to an intake port at ground level spaced from the conical top. The first and second conduits are made as tubing of a material transparent to nuclear radiation and of sufficient length to traverse a nonlinear path as installed. The connections between the conduit and the roof and downtube are shielded by flexible connection shields.

The first and second conduits have filters to exclude toxic agents and spring loaded closure mechanisms operable to seal the conduits during periods of extreme atmospheric toxicity, radioactivity, temperature or pressure.

A fiber optic cable provides light to the interior of the shelter from a light gathering means at ground level. A fiber optic mat inside the shelter is connected to the cable, and individual fibers of the mat have transverse light outlets to release light therefrom to the interior.

In an alternative embodiment the roof has a substantially vertical lower sidewall and the lower edges supported by the base member are the lower edges of the sidewall. In this embodiment, the roof has an opening at its zenith and a ccmpression ring surrounds the opening, and a tension ring surrounds the upper edge of the sidewall.

The invention also encompasses a kit of materials to be assembled quickly on site into an underground shelter to protect occupants therein from the adverse effects of a nuclear detonation. The kit includes a plurality of arcuate drive ring sections sufficient in length and number to be assembled into a peripheral base member. These sections are crushable in response to the barometric overpressure of a nuclear detonation. The kit also includes a plurality of curved wedge section panels sufficient in size and number and adapted to be mounted on an assembled base member of drive ring sections in formation of a structure with an arched roof. A plurality of planar wedge panels are provided sufficient in size and number to be assembled into a floor under the roof. Each of the drive ring panels, curved wedge section panels, and planar wedge section panels is of such size and weight that two persons can manipulate it without powered assistance, so the materials may be assembled to form the shelter.

BRIEF DESCRIPTION OF THE DRAWINGS

The invention will be better understood from a reading of the following detailed description in conjunction with the drawings in which:

FIG. 2 is a perspective view of one of the panel sections used in formation of the domed shelter of FIG. 1;

FIG. 3 is a sectional view of the abutment of flanges of two panel sections and illustrating a preferred retaining means therefor;

FIG. 4 is a sectional view similar to FIG. 3 but illustrating a different type of panel flange;

FIG. 5 is a perspective view, partially broken away, of two drive ring sections and the engagement of a panel section in one of them;

FIG. 6 is a sectional view taken along lines 6—6 in FIG. 5 looking in the direction of the arrows;

FIG. 7 is a sectional view of the zenith of the shelter of FIG. 1

FIG. 8 is a plan view of the shelter floor;

FIG. 9 is a plan view of one of the panel sections making up of the floor;

FIG. 10 is a sectional view taken along lines 10—10 of FIG. 9;

FIG. 11 is a perspective view, partially sectioned, of a pier used in supporting the floor;

FIG. 12 is a schematic view of the underground shelter and its illumination system;

FIG. 13 is an enlarged, perspective view, partially broken away, of an optic fiber mat used for internal illumination;

FIG. 14 is a plane view showing the locations of the internal partitions of the shelter;

Figure 1:
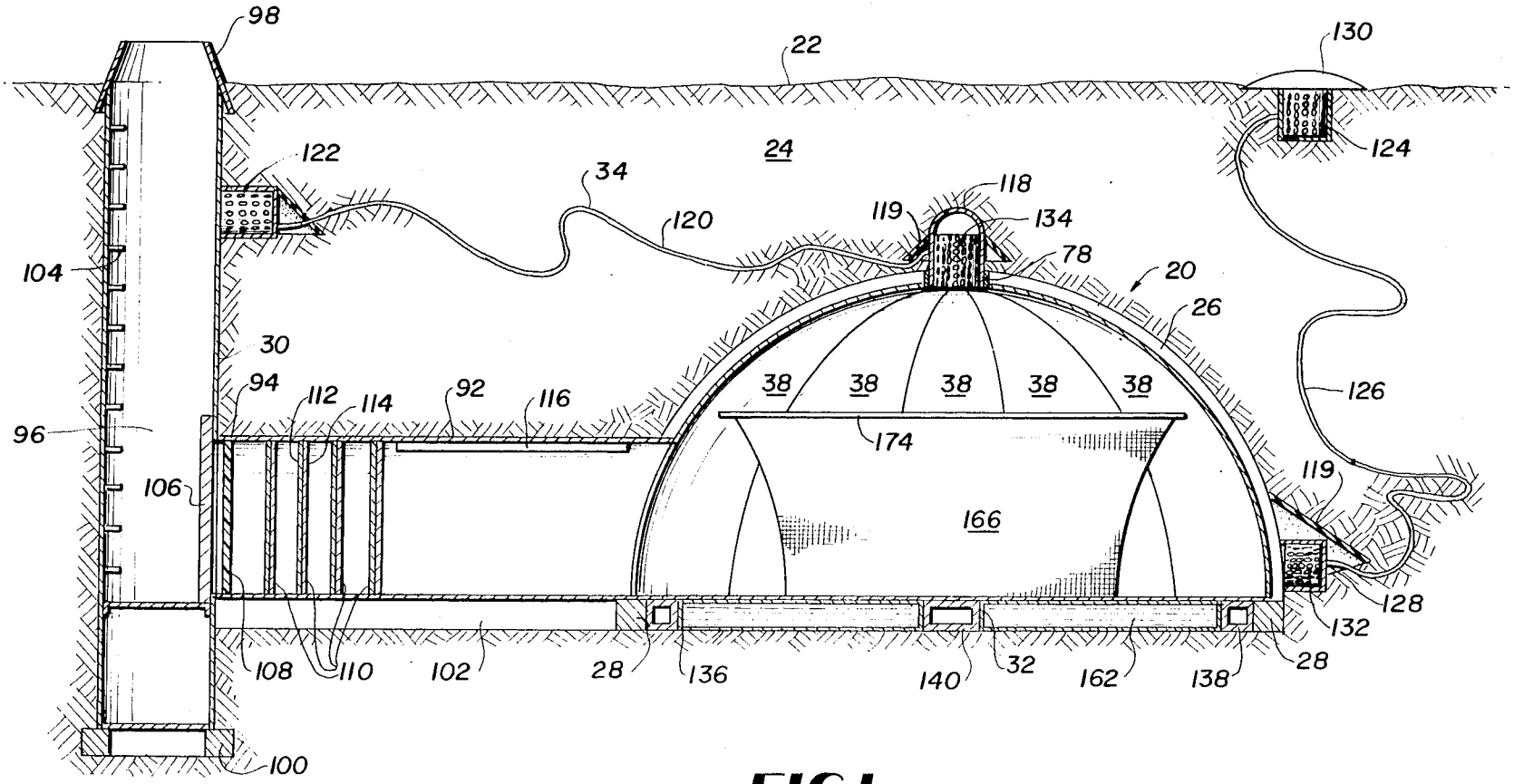
FIG. 1 is a sectional, somewhat schematic view of a domed underground shelter according to the invention.

ring sections can be assembled in a lapped arrangement, as shown in FIG. 5. Adjacent drive ring sections 80 are held together by a fastening means 90, shown schematically in FIG. 5. The fastening means 90 may be of any suitable type, preferably carried on the drive ring sections 80 and may be the type shown in FIG. 3.

As shown in FIGS. 1 and 12, access to the shelter 20 is made possible by entryway 30. Entryway 30 is made up of a lateral passageway 92 extending substantially horizontally from the shelter 20 to a distal end 94 thereof and a downtube 96 extending from the distal end 94 upward to a truncated conical top 98 above ground. The downtube 96 also extends downwardly and rests on its own drive ring 100 made according to the same techniques as drive ring base member 28. Likewise, the lateral passageway 92 is supported by its own drive member 102. The sidewalls of lateral passageway 92 and downtube 96 are formed in sections of the same materials and joined together in the same manner as the arched roof 26. As will be apparent, the sizes and shapes of the sections are adapted to the passageway shape, and the drive ring 100 and drive members 102 are likewise designed for interengagement with the panels of passageway 92 and downtube 96.

The truncated conical top 98 which defeats blast-wave penetration, is provided with a coating of ceramics and other ablative material and extends above ground for approximately two feet. The sidewall of downtube 96 is provided with ladder rungs 104 to allow occupants to ascend and descend.

The lateral passageway 92 is provided with a plurality of doors to shield the occupants of shelter 20 from radiation and chemical and biological agents. The first door 106 is a quarter inch thick iron plate to slow down very fast neutrons to moderately fast neutrons through the process of inelastic scattering. The door extends vertically and horizontally in the downtube beyond the edges of the lateral passageway and is provided with a locking mechanism.

The second door 108 is airtight to prevent the pentration of airborne particulate material, biological agents and toxic chemicals. The door fills the passageway 92 and may be made from a fiber reinforced plastic or aluminum. It has an interior compartment filled with layers of polyethylene to a thickness of at least 6 inches to slow down moderately fast neutrons to the slow or thermal range through the process of elastic scattering.

A series of doors 110 are provided, alternately hinged to opposite sides of the passageway 92. The doors 110 have two metal plates essentially filling the passageway, wrapped by fiber reinforced plastic. The metal plate nearest the downtube 96 is filled with a boron compound to further attenuate neutron energies. A particularly preferred plate is a one fourth inch thick dispersion of boron carbide particles in a matrix of aluminum, as disclosed in U.S. Pat. No. 2,727,996 to Rockwell III, the disclosure of which is incorporated herein by reference. The second metal plate of each door is one-half inch of lead. The two-layer doors absorb thermal neutrons and gamma radiation streaming within the entry system. As will be apparent, the doors 110 are of considerable weight, but providing them as a multiplicity of units breaks the weight of each down to level managable by two persons. The ceiling of lateral passageway 92 may be provided with a mat 116 of fiber-optics fibers, having transverse light outlets therein and being connected to a light source, to provide illumination to the lateral passageway, as will be discussed further in connection with FIG. 12. The mat 116 may be separate or an integral, outer layer of a panel making up passageway 92.

The ventilation system 34 for the shelter 20 is depicted in FIGS. 1 and 7. A low pressure envelope is generated just above the truncated conical top 98 wherever a breeze blows. An outlet 118 from the top of the arched roof 26 is connected by way of a first conduit 120 to exhaust port 122 in the downtube 96. Likewise, an intake port 124 is connected by a second conduit 126 to an inlet 128 in a lower portion of the shelter 20. Intake and exhaust ports 122 and 124 may be provided with spring loaded closure mechanisms to temporarily seal off the shelter during periods of particularly hazardous atmospheric conditions. These closures may be thermally, barometrically, and/or manually activated. These ports 122 and 128 are preferably of the type protected from blast wave overpressures as disclosed in U.S. Pat. No. 3,075,448 to Cohen, the disclosure of which is incorporated herein by reference. The conduit connections at outlet 118 and inlet 128 are shielded by flexible connection shields 119 to prevent disconnection during deflection of the roof by an airslap. As seen in FIG. 7 the outlet 118 is threaded to the compression ring 78. The relative elevations of inlet 128 and outlet 118 contribute to the movement of ventilation air by virtue of temperature differentials caused by heat from the occupants of the shelter 20. The intake port 124 is open at ground level to the atmosphere through an ablative coated oblate dome 130. The pressure differential between dome 130 and conical top 98, and the temperature differential within the shelter 20 induces air intake at port 124 and exhaust at port 122.

The first and second conduits 120 and 126 are made of a flexible tubing, preferably polyethylene or some other material which is transparent to nuclear radiation. As is shown in FIG. 1, the conduits are looped back and forth to attenuate streaming radiation therein. Thus, the conduits 120 and 126 must be of sufficient length to allow them to be installed in such a traversing path. Also installed in line in the inlet and outlet are filters 132 and 134 to filter out radioactive dust, chemical and biological agents, and the like. Preferably, the filter includes activated charcoal.

As can be seen in FIGS. 1, 8, 9, 10 and 11, the shelter is provided with a floor system 32. The floor is isolated from the arched roof 26 and drive ring base member 28 so that forces acting on the drive ring and roof are not transmitted to the floor system. Rather, the floor is independently supported on piers such as 136, 138 and 140. Pier 136, seen in FIG. 11 is formed of materials similar to the arched roof and base members. It includes an inner layer 142 of lightweight, but strong foam material and an outer layer 144 of fiber reinforced plastic. The other pieces are formed similarly. The floor which rests on the piers is made up of a plurality of planar wedge section members 146. Each wedge section member 146 has an overlap edge 148 with spaced protruding rings 150 and an underlap edge 152 with friction posts 154 on which the rings 150 of an adjacent member 146 may be engaged to lock the wedge section members together. If desired the bottom of planar section members 146 may be provided with transverse trusses 156, shown in phantom in FIG. 9. In the embodiment shown in FIG. 1, these have been omitted. The circumferential edge of each section is provided with a flexible flap 158 and a flexible water-tight boot 160 to assure a water-tight joint with peripheral skirting in the form of the inside of the arched roof 26 and drive ring base member FIG. 15 is a perspective view of another shelter embodiment.

DETAILED DESCRIPTION OF THE PREFERRED EMBODIMENT

As seen in FIG. 1, the shelter 20 is located below the level of the ground surface 22 in order to provide a defiladed location. This protects the shelter from the thermal pulse and dynamic pressures generated by nuclear detonation. The shelter 20 is covered with soil 24. The soil 24 serves not only to provide a defiladed emplacement, but also provides shielding from prompt radiation. Other advantageous aspects of the underground location of shelter 20 will become apparent hereinafter.

The shelter 20 includes an arched roof 26, a drive ring base member 28, an entry way 30, a floor system 32 and a ventilation system 34. An illumination system 36 is also provided, as shown in FIG. 12.

Arched roof 26 is made up of a plurality of curved wedge section panels 38, one of which is seen in FIG. 2. As seen in FIG. 2, the panel has a mid section 40, longitudinal edge flanges 42 and 45 and a compression ring abutment plate 44. In the embodiment shown in FIG. 2, the panel 38 is provided with a door 43 as would be used to communicate with the entry way 30. Only one of the multiplicity of panels 38 is provided with a door 43, the remainder having continuous midsections 40.

Each panel 38 is made of light weight but strong plastics materials such as a thermoplastic or thermosetting plastic. The plastic material has a high strength-to-weight ratio. In a preferred embodiment a laminate surrounding a foam material is reinforced with fiber glass, carbon fiber, Kevlar fiber, or other fiber-reinforcing material. In the particularly preferred embodiment, a central core of closed cell polyvinyl foam is provided with one or more laminates of a fiber reinforced epoxy or other thermosetting plastic sheathing. This can be seen in FIG. 3 which shows two adjacent panels 38 and 39. In the panel 38, a foam core 46 is sandwiched between resin and fiber reinforced sheathing layers 48.

Although in the preferred embodiment the arched roof 26 is a dome, other arched shapes can be used, including a semicylindrical roof with arched ends, and the like. The arch provides advantages of increased strength and a large interior clear span space, and also serves to attenuate blast wave loading, as will be discussed further hereinafter.

The number, size, and shape of the panels 38 may vary with the size and shape of the shelter 20, but limited by the criterion that each panel be manipulable by two men, without powered assistance. Preferably, the panels also conform to normal storage and vehicular cargo spaces.

Referring again to FIGS. 2 and 3, each panel 38 or 39 has two longitudinal edge flanges 42 and 45. The male flange 42 has a protruding V-shaped tongue 50, while the female flange 45 has a corresponding groove 52 into which tongue 50 fits to provide a mechanical interlock between adjacent flanges.

Each of the flanges 42 and 45 are formed with longitudinal reinforcements 54 and 56 to provide additional strength along the edges 42 and 45. The reinforcements are preferably steel, but could also be aluminum or other stiffening material. Disposed within the bottom of groove 52 is a longitudinal caulking bead 58 to provide a watertight and airtight joint between the adjacent assembled panels.

The panels can be retained together in any suitable manner, but preferably carry their own means for doing so. It is contemplated that the shelter is likely to be assembled with little time to spare and amid the confusion of tactical combat conditions. Accordingly, it is advantageous to provide the means for retaining the adjacent panels together on the panels themselves to prevent delays caused by lost or mismatched parts.

In a preferred embodiment shown in FIG. 3, the panels are retained by a simple buckle mechanism. A handle 60 and opening 66 are provided on the metal reinforcements 54 and 56, within recesses 72 in the foam layer 46 of the flanges 42 and 45. The handle means 60, shown in its open position in FIG. 3, is provided with a latch means including a hook 62 and a strap or cable 64. Preferably the strap 64 is made of Kevlar. Opening 66 in the female flange 45 acts as a receptor for receiving hook 62 while handle means 60 is in its open position. Moving handle 60 in the direction of arrow 68 to a position juxtaposed the male flange 42 draws the male and female flanges together, causing the protruding tongue 50 of the male flange to enter the groove 52 of the female flange and be sealed by the caulking bead 58. The handle means 60 is held in its closed position by any convenient means, such as a lock 70. A multiplicity of retaining means are provided along the flanges 42 and 45, as shown by the recesses 72 shown in FIG. 2. Notches 74 are formed in the flanges to serve as a stair steps to enable personnel assembling the shelter to reach retaining means at upper levels of the panel 38.

In assembly of the shelter, the tongue of the last panel to be located in position will be obstructed by the mating female flange. Accordingly, as shown in FIG. 4, the tongue 51 of such panel is provided outwardly urged by a spring 75. This allows tongue 51 to pass by the edges of the female flange by compression of the spring 75 and thereafter be locked into place in the corresponding female groove.

Upon assembly, the flanges 42 and 45 combine together to form an arched, thickened rib which strengthens the roof 26 of the shelter 20. The compression ring abutment plates 44 of panels 38 form a cylindrical wall which abuts compression ring 78. If one particular panel 38 should be subjected to excessive stress during the overpressure generated by a nuclear detonation, the compression ring 78 distributes excess compressive load from that panel to others in the roof 26. If the shelter 20 is provided of shape other than as a dome, a corresponding modification in the shape of the compression ring should be made.

Referring to FIGS. 1, 5, and 6, drive ring base member 28 is made up of a plurality of drive ring sections 80. Each section 80 has a curvature matching the lower portion of a curved wedge section panel 38, so that after assembling all of the drive ring sections 80 into the complete drive ring base member 28, the arched roof 26 can be assembled thereon. As shown in FIG. 6, each drive ring section includes a core of relatively low density polyvinyl foam 82 or other similar rigid, but low density material encased in a fiber reinforced sheathing 84. Along the tops of the drive ring sections 80, the sheathing 84 is provided with thin portions 86 appearing as grooves and arranged in alignment with the edges of the corresponding panel 38, as shown in FIG. 5. The thin sections 86 serve as alignment guides for the panel 38 and also as fracture lines, as will become more apparent later. Each drive ring section is made with an overhanging end 88 and a lip 89 so that the plurality of drive 28. A reservoir 162 of potable water is located below the wedge section members.

The top surface of certain of the planar wedge section members 146 may be provided with friction caps 164 to fasten and align the interior walls 166 shown in FIG. 14. The interior walls 166 are formed of similar materials as before, but are hollow to provide storage space for equipment and supplies. The interior walls are joined together by integral buckles like those used to join adjacent panels 38. One of the walls 168 is provided with sanitation facilities 170. Also, the walls may be provided with fold down desks 172 or other furniture fixtures. As seen in FIG. 12, a second floor 174 is provided of the same material and using the same construction techniques as floor system 32.

FIGS. 12 and 13 illustrate the internal illumination system. Disposed on internal surfaces of the shelter is a mat 176 of optical fibers. The mat may be formed as an integral part of one or more of the curved wedge section panels 38 or interior walls 166, or be otherwise arranged within the shelter. The mat is connected by way of a fiber-optics cable 178 to a light gathering lens 180 at ground level. The light system may provide for a shift to generated red light for night operations. Certain of the fibers within the mat are serrated, scratched, or by some other fashion caused to leak light laterally from the fiber axis and into the interior of the shelter.

FIG. 15 discloses another embodiment of the invention in which an arched roof 182 is supported on a vertical sidewall 184 and the lower edge of the sidewall 184 is mounted on a drive ring base member 28 like the one shown in FIG. 1 and described above. In this embodiment, a tension ring 186 is provided around the top of the sidewall to prevent radial distortion thereof during airslap deflection. The construction materials and other aspects of the invention are the same as for the embodiment shown in FIGS. 1 through 14.

The shelter is designed to be assembled quickly and easily with a minimum of manpower and equipment. A first step is the provision of some form of excavation, such as may be provided by a bulldozer, front end loader, backhoe or by means of explosives or the like. Then, the drive ring base member 28 is assembled from a plurality of drive ring sections 80. Piers 136, 138, and 140 and potable water reservoir 162 are located within the drive ring base member 28. Then the floor is assembled on the piers from planar wedge section members 146, with the components of the interior walls and second floor deposited on the first floor. Arched roof 26 is assembled on top of the drive ring base member 28, as the compression ring and outlet 118 are installed. Fiber-optics cable 78 is connected to internal mats 176, and second conduit 126 is connected to inlet 128. Drive member 102 and drive ring 100 are put in place, and lateral passageway and downtube 96 are assembled thereon. The doors 106, 108 and 110 are put in place, and the first conduit 120 is connected. Oblate dome 130 and its intake port 124 are connected to second conduit 126 and put in position, and light gathering lenses 180 are connected to fiber-optics cable 178. Then soil is backfilled around the shelter, preferably to a depth of at least eight feet over the top of the shelter. The occupants may then enter the shelter and assemble the interior walls and second floor.

In the event of the detonation of a nuclear weapon, proximate the so-emplaced shelter, the occupants will be protected from the dynamic blast wave and thermal pulse generated by the detonation by the underground location of the shelter. The blast wave overpressure will cause an air slap on the ground surface 22, which will the transmitted through soil 24 to arched roof 26 and drive ring base member 28. The force will fracture drive ring base member 28, drive ring 100 and drive member 102 as the respective structure assembled thereon deflects downwardly into the drive base. The fracturing and downward deflection are made possible by the thinned section 86 of the fiber reinforced sheathing 84 of each drive member section 80 and the low sensity of the foam 82 therein. The downward deflection takes some finite period of time, thus spreading the deflection force over time and decreasing the instantaneous magnitude thereof on roof 26. Moreover, the deflection of roof 26 leaves a rarefied zone immediately thereabove so the soil 24 above that zone transmits a substantial proportion of the airslap force laterally outwardly away from the shelter 20.

The occupants of the shelter are not subjected to the force of the airslap because the floor system 32 which supports them is independent of the arched roof and drive ring 28.

During the passage of the overpressure and for some period thereafter, the ventilation system 34 is closed by automatic closure means. The ventilation system is reopened when conditions become less severe. The occupants of the shelter are protected from radiation by the soil 24 over the top of the arched roof. Moreover, the doors 106, 108 and 110 prevent streaming radiation from entering the interior of the roof, by the mechanisms described above.

Preferably, the shelter provides a minimum of 35 square feet of space per occupant. In a preferred design, a semispherical dome of 12 foot radius is provided to house 10 persons.

As will be apparent, the shelter can be made in various configurations and with various other features, while still within the scope of this invention.

What is claimed is:

1. A shelter for protecting occupants therein from dynamic blast waves and barometric overpressure created by an above ground nuclear detonation proximate to said shelter, said shelter being buried below ground under soil, said soil comprising means for the attenuation of the dynamic blast wave generated by the detonation, said shelter having a semipherical domed roof and a base means supporting the roof, said semipherical domed roof being downwardly displaceable and having a lower edge which is vertically and downwardly movable in response to barometric overpressure generated by the detonation, said base means being a ring made up of a plurality of arcuate sections, said arcuate sections of said base means being crushable in response to the vertical downward movement of the roof to enable the roof to move downwardly to a lower position where it is supported on the crushed base member, said overpressure being transmitted through the soil surrounding said roof.

2. A shelter as claimed in claim 1 wherein a fiber optic cable provides light to the interior of said roof from a light gathering means adapted to be situated at ground level.

3. A shelter as claimed in claim 2 wherein a fiber optic mat is provided on the inside of said roof and is optically connected with said fiber optic cable, individual fibers of said mat having transverse light outlets to release light therefrom to the interior.

4. A shelter as claimed in claim 1 wherein said roof is made up of a plurality of curved wedge section panels.

5. A shelter as claimed in claim 4 wherein said roof has a zenith and said section panels abut a compression ring at said zenith.

6. A shelter as claimed in claim 4 wherein said wedge section panels are laminates of rigid sheathing and a foamed plastic core.

7. A shelter as claimed in claim 6 wherein said sheathing is a fiber-reinforced thermosetting plastic.

8. A shelter as claimed in claim 4 wherein said wedge section panels have edge reinforcements.

9. A shelter as claimed in claim 8 wherein adjacent panels meet at tongue and groove joints.

10. A shelter as claimed in claim 9 wherein said joints are caulked.

11. A shelter as claimed in claim 8 wherein adjacent panels are held together by manually operable retaining means affixed to said panels.

12. A shelter as claimed in claim 11 wherein said retaining means comprises a handle mounted on a surface of one panel and pivotable between an open position in which it is angled to the panel surface and a closed position in which it is juxtaposed the panel surface, a latch extending from said handle and a receptor for said latch on an adjacent panel, whereby said latch may be inserted in said receptor when said handle is in its open position and tensioned to draw said panels together by moving said handle to its closed position.

13. A shelter as claimed in claim 12 wherein said retaining means further comprises a means for holding said handle in its closed position.

14. A shelter as claimed in claim 8 wherein said edge reinforcements are made of metal.

15. A shelter as claimed in claim 1 further comprising a floor located under said roof but not connected to said roof or said base mean.

16. A shelter as claimed in claim 15 wherein said floor is made up of a plurality of planar wedge section panels.

17. A shelter as claimed in claim 16 wherein said panels have truss reinforcements.

18. A shelter as claimed in claim 16 wherein said planar panels are supported on piers.

19. A shelter as claimed in claim 16 wherein said planar panels include peripheral skirting engaging said roof in watertight manner.

20. A shelter as claimed in claim 16 further comprising interior walls supported on said floor and an upper deck supported on said interior walls.

21. A shelter as claimed in claim 20 wherein one of said interior walls is provided with sanitation facilities.

22. A shelter as claimed in claim 1 wherein said roof has a substantially vertical lower sidewall and said lower edges are the lower edges supported by said base member of said sidewall.

23. A shelter as claimed in claim 22 wherein said roof has an opening at its zenith and a compression ring surrounds said opening.

24. A shelter as claimed in claim 22 further comprising a tension ring surrounding the upper edge of said sidewall.

25. A shelter according to claim 1 having a floor system which is surrounded by said base means, said floor system being supported independently from said roof and base means so that said downward movement of said semispherical domed roof is not transmitted to said floor system.

26. A shelter as claimed in claim 1 wherein said arcuate sections are laminates of a rigid sheathing and a foamed plastic core and are fracturable to allow said roof to crush the arcuate sections in response to the barometric overpressure of a nuclear detonation.

27. A shelter as claimed in claim 1 having an entryway including a lateral passageway extending substantially horizontally from said roof to a distal end and a downtube extending from said distal end of said lateral passageway upward to a truncated conical top above ground when the roof is below ground.

28. A shelter as claimed in claim 27 having an oblative coating on said truncated conical top.

29. A shelter as claimed in claim 27 wherein said lateral passageway and downtube are made of laminated panels including a rigid sheathing and a foamed plastic core.

30. A shelter as claimed in claim 29 wherein said sheathing is a fiber-reinforced thermosetting plastic and at least some of the fibers thereof conduct light and have transverse light outlets to release light therefrom to said lateral passageway.

31. A shelter as claimed in claim 27 wherein said entryway is provided with a series of doors made of materials which attenuate radiation.

32. A shelter as claimed in claim 31 wherein one of said doors is made of iron for attenuating the energy of fast neutrons by inlastic scattering.

33. A shelter as claimed in claim 31 wherein one of said doors includes layers of polyethylene film for attenuating the energy of neutrons by elastic scattering.

34. A shelter as claimed in claim 31 wherein one of said doors includes a layer of boron carbide particles dispersed in a matrix of aluminum and a layer of lead.

35. A shelter as claimed in claim 34 including a plurality of such two layer doors, alternate ones of which are hinged to opposite sides of said entryway.

36. A shelter as claimed in claim 27 further comprising a ventilation system including an outlet from the top of said roof connected by a first conduit means to an exhaust port in said downtube of said entryway and an inlet to a lower level of said roof connected by a second conduit means to an intake port at ground level spaced from said conical top.

37. A shelter as claimed in claim 36 wherein said first and second conduit means comprise tubing of a material transparent to nuclear radiation and of sufficient length to traverse a nonlinear path as installed.

38. A shelter as claimed in claim 37 wherein connections between said conduit means and said roof and downtube are shielded by flexible connection shields.

39. A shelter as claimed in claim 37 wherein said first and second conduit means have filters and spring loaded closure mechanisms operable to seal said conduit means during periods of extreme atmospheric toxicity, radioactivity, temperature or pressure.

* * * * *